United States Patent [19]

Yu et al.

[11] Patent Number: 5,008,169

[45] Date of Patent: Apr. 16, 1991

[54] PHOTOCONDUCTIVE IMAGING MEMBERS WITH POLYPHOSPHAZENES

[75] Inventors: Robert C. U. Yu, Webster; Santokh S. Badesha, Pittsford, both of N.Y.

[73] Assignee: Xerox Corporation, Stamford, Conn.

[21] Appl. No.: 386,321

[22] Filed: Jul. 28, 1989

[51] Int. Cl.[5] ..... G03G 5/047

[52] U.S. Cl. ..... 430/59; 430/60; 430/61; 430/126

[58] Field of Search ..... 430/60, 61, 59, 126; 528/167, 168

[56] References Cited

U.S. PATENT DOCUMENTS 4,657,993 4/1987 Lora et al. ..... 528/167

4,889,910 12/1989 Bordere et al. ..... 528/168

*Primary Examiner*—John Goodrow

*Attorney, Agent, or Firm*—E. O. Palazzo

[57] ABSTRACT

A photoconductive imaging member comprised of a supporting substrate, a ground plane layer, a hole blocking-adhesive layer comprised of a polyphosphazene, including polyorganophosphazenes, a photogenerating layer, and a hole transport layer.

33 Claims, 1 Drawing Sheet

PHOTOCONDUCTIVE IMAGING MEMBERS WITH POLYPHOSPHAZENES

BACKGROUND OF THE INVENTION

This invention is generally directed to photoconductive imaging members, and more specifically to imaging members with polyphosphazene, including polyorganophosphazene hole blocking layers. The present invention in one embodiment is directed to layered imaging members comprised of a photogenerating layer, a charge transport layer, and a charge blocking layer comprised of polyphosphazenes. In a specific embodiment, the present invention relates to layered imaging members comprised of a supporting substrate, a hole blocking layer comprised of polyphosphazenes, a photogenerating layer and a hole transport layer, especially an aryl amine, wherein the amine molecules are dispersed in an inactive resin binder. Further, in another embodiment of the present invention the imaging member is comprised of a supporting substrate, a hole blocking layer comprised of polyphosphazenes, which polyphosphazenes also possess adhesive characteristics, thereby avoiding the need for a separate adhesive layer, such as a polyester, a photogenerating layer, and in contact therewith a charge transport layer. The charge, especially hole, transport layer can be located as the top layer of the imaging member, or it may be situated between the supporting substrate and the photogenerating layer. The aforementioned polyphosphazene hole blocking-adhesive material possesses a number of advantages including, but not limited to, for example, its adhesive characteristics, especially for seamless layered imaging members; the capability of the polyphosphazene to form smooth thin uniform films by, for example, solution coating as compared to known silane layers, which form in many instances undesirable islands, and nonuniform films; stable properties when dissolved in solvents; the polyphosphazene coating can be applied by spray, dipped, or web coating processes permitting more economical processes, and improved efficiency; resiliency characteristics compared to, for example, the brittle characteristics of organo silane layers which causes cracking; and the like. The imaging members of the present invention can be selected for a number of imaging and printing processes including electrophotographic imaging and printing processes for an extended number of imaging cycles, while substantially avoiding or minimizing undesirable separation of the layers, substantially avoiding or minimizing undesirable charge injection from the supporting substrate to the photogenerating and other layers of the imaging member, excellent adherence to the metal ground plane layer situated on the supporting substrate in some embodiments, superior and ease of coatability of the polyphosphazenes, adherence to a number of substrates such as conductive polymers, metals and the salts thereof such as copper iodide, organic ground planes, and the like, thus enabling seamless imaging members.

The formation and development of electrostatic latent images on the imaging surfaces of photoconductive materials by electrostatic means is well known. Numerous different photoconductive members for use in xerography are known such as selenium, alloys of selenium, layered imaging members comprised of aryl amine charge transport layers, reference U.S. Pat. No. 4,265,990, and imaging members with charge transport layers comprised of polysilylenes, reference U.S. Pat. No. 4,618,551. The disclosures of the aforementioned patents are totally incorporated herein by reference.

In a patentability search report, there were recited the following United States patents: U.S. Pat. No. 4,657,993 directed to polyphosphazene homopolymers and copolymers with hydroxylated or amino derivatives, for example, reference the Abstract of the Disclosure, which polyphosphazenes can be selected as photoconductor materials and can be used for the reproduction of images or for other uses, see column 1, line 55, to column 2, line 21; and primarily of background interest, U.S. Pat. No. 3,370,020 directed to phosphonitrilic polymer mixtures, reference the Abstract of the Disclosure; U.S. Pat. No. 3,515,688 directed to copolymers containing phosphonitrile elastomers, reference the Abstract of the Disclosure for example; U.S. Pat. No. 3,702,833 directed to curable fluorophosphene polymers, reference the Abstract of the Disclosure and column 1; and U.S. Pat. No. 3,856,712 directed to polyphosphazene copolymers, which are elastomers, reference the Abstract of the Disclosure and column 1. The disclosures of each of the aforementioned patents are totally incorporated herein by reference.

The following patent applications and U.S. patents which illustrate layered imaging members with adhesive and hole blocking layers in some instances are mentioned: (1) U.S. Pat. No. 4,818,650 describes layered imaging members with novel polymeric, hydroxy and alkoxy aryl amines, wherein m is a number of between about 4 and 1,000 reference for example claims 1 and 2; (2) U.S. Ser. No. 061,247 (now abandoned) and U.S. Pat. No. 4,871,634 illustrate imaging members with novel dihydroxy terminated aryl amine small molecules, reference claims 1 and 2 for example; (3) U.S. Pat. No. 4,806,444, the disclosure of which is totally incorporated herein by reference, describes layered imaging members with novel polycarbonate polymeric aryl amines, reference claims 1 and 2, for example; (4) U.S. Pat. No. 4,806,443, the disclosure of which is totally incorporated herein by reference, illustrates novel polycarbonate polymeric amines useful in layered imaging members, reference claims 1 and 2 for example; and (5) U.S. Pat. No. 4,801,517, the disclosure of which is totally incorporated herein by reference, which discloses imaging members with novel polycarbonate aryl amines, reference claims 1 and 2, for example.

In U.S. Pat. No. 4,869,988 and U.S. Pat. No. 4,946,754 entitled, respectively, PHOTOCONDUCTIVE IMAGING MEMBERS WITH N,N-BIS(BIARYLYL-)ANILINE, OR TRIS(BIARYLYL)AMINE CHARGE TRANSPORTING COMPONENTS, and PHOTOCONDUCTIVE IMAGING MEMBERS WITH BIARYLYL DIARYLAMINE CHARGE TRANSPORTING COMPONENTS, the disclosures of which are totally incorporated herein by reference, there are described layered photoconductive imaging members with transport layers incorporating biarylyl diarylamines, N,N-bis(biarylyl)anilines, and tris(-biarylyl)amines as charge transport compounds. In the abovementioned patents, there are disclosed improved layered photoconductive imaging members comprised of a supporting substrate, a photogenerating layer optionally dispersed in an inactive resinous binder, and in contact therewith a charge transport layer comprised of the abovementioned charge transport compounds, or mixtures thereof dispersed in resinous binders. These patent applications also disclose, for example, polyester adhesive and metal oxide or organo silane hole blocking layers.

Examples of specific hole transporting components disclosed in U.S. Pat. No. 4,869,988 include N,N-bis(4-biphenylyl)-3,5-dimethoxyaniline (Ia); N,N-bis(4-biphenylyl)-3,5-dimethylaniline (Ib); N,N-bis(4-methyl-4'-biphenylyl)-3-methoxyaniline (Ic); N,N-bis(4-methyl-4'-biphenylyl)-3-chloroaniline (Id); N,N-bis(4-methyl-4'-biphenylyl)-4-ethylaniline (Ie); N,N-bis(4-chloro-4'-biphenylyl)-3-methylaniline (If); N,N-bis(4-bromo-4'-biphenylyl)-3,5-dimethoxyaniline (Ig); 4-biphenylyl bis(4-ethoxycarbonyl-4'-biphenylyl)amine (IIa); 4-biphenylyl bis(4-acetoxymethyl-4'-biphenylyl)amine (IIb); 3-biphenylyl bis(4-methyl-4'-biphenylyl)amine (IIc); 4-ethoxycarbonyl-4'-biphenylyl bis(4-methyl-4'-biphenylyl)amine (IId); and the like.

Examples of specific hole transporting compounds disclosed in U.S. Pat. No. 4,946,754 include bis(p-tolyl)-4-biphenylylamine (IIa); bis(p-chlorophenyl)-4-biphenylylamine (IIb); N-phenyl-N-(4-biphenylyl)-p-toluidine (IIc); N-(4-biphenylyl)-N-(p-chlorophenyl)-p-toluidine (IId); N-phenyl-N-(4-biphenylyl)-p-anisidine (IIe); bis(m-anisyl)-4-biphenylylamine (IIIa); bis(m-tolyl)-4biphenylylamine (IIb); bis(m-chlorophenyl)-4-biphenylylamine (IIIc); N-phenyl-N-(4-biphenylyl)-m-toluidine (IIId); N-phenyl-N-(4-bromo-4'-biphenylyl)-m-toluidine (IVa); diphenyl-4-methyl-4'-biphenylylamine (IVb); N-phenyl-N-(4-ethoxycarbonyl-4'-biphenylyl)-m-toluidine (IVc); N-phenyl-N-(4-methoxy-4'-biphenylyl)-m-toluidine (IVd); N-(m-anisyl)-N-(4-biphenylyl)-p-toluidine (IVe); bis(m-anisyl)-3-biphenylylamine (Va); N-phenyl-N-(4-methyl-3'-biphenylyl)-p-toluidine (Vb); N-phenyl-N-(4-methyl-3'-biphenylyl)-m-anisidine (Vc); bis(m-anisyl)-3-biphenylylamine (Vd); bis(p-tolyl)-4-methyl-3'-biphenylylamine (Ve); N-p-tolyl-N-(4-methoxy-3'-biphenylyl)-m-chloroaniline (Vf), and the like.

It is also indicated in the aforementioned two copending applications that there may be selected as resin binders for the charge transport molecule components as illustrated in U.S. Pat. No. 3,121,006, the disclosure of which is totally incorporated herein by reference including polycarbonates, polyesters, epoxy resins, and the like. The aforementioned binders may also be selected as resin binders for the charge transport, and in some embodiments the photogenerating layers of the present invention.

While the abovementioned layered imaging members are suitable for their intended purposes, there continues to be a need for improved imaging members, particularly layered members, wherein the adhesive layer can be eliminated. Another need resides in the provision of layered imaging members wherein polyphosphazenes, including inorganic (phosphorous substituents such as inorganic metals, like copper) and polyorganophosphazenes can be selected as both the hole blocking layer and the adhesive layer. Further, there continues to be a need for layered imaging members wherein the layers are sufficiently adhered to one another to allow the continuous use of such members in repetitive imaging and printing systems. Also, there continues to be a need for improved seamless layered imaging members. Furthermore, there is a need for layered imaging members with the other advantages illustrated herein.

SUMMARY OF THE INVENTION

It is therefore an object of the present invention to provide layered photoresponsive imaging members with many of the advantages indicated herein.

It is also an object of the present invention to provide layered photoconductive imaging members with polyorganophosphazenes that possess hole blocking and adhesive characteristics.

It is yet another object of the present invention to provide layered photoresponsive imaging members with a hole transport layer in contact with a photogenerating layer, which members are suitable for use with liquid or dry developers.

In a further object of the present invention there is provided a layered photoresponsive imaging member with a photogenerating layer situated between a supporting substrate and a charge, especially hole, transport layer with a hole blocking layer comprised of polyphosphazenes in contact with a ground plane layer.

In yet another object of the present invention there is provided a photoresponsive imaging member comprised of a hole transporting polymer layer situated between a supporting substrate and a photogenerating layer.

In another object of the present invention there are provided imaging and printing processes with the layered imaging members, including seamless members disclosed herein.

A further object of the present invention is to provide improved layered imaging members wherein the problems illustrated herein are avoided or minimized.

These and other objects of the present invention are accomplished by the provision of layered imaging members comprised, for example, of a hole blocking-adhesive polyphosphazene, especially polyorganophosphazene layer, a photogenerating layer and a charge transport layer. More specifically, the present invention is directed to layered imaging members comprised of a supporting substrate, a ground plane layer, a hole blocking-adhesive polyorganophosphazene layer, a photogenerating layer, and in contact therewith a hole transport layer comprised of, for example, aryl amines, N,N-bis(biarylyl)aniline polymers, stilbenes, pyrazolenes, polymers thereof, polyvinylcarbazole, polysilylenes, and the like dispersed in a resin binder, including polyorganophosphazene binders, reference for example copending application U.S. Ser. No. 07/386,322, entitled "Photoconductive Imaging Members With Polyphosphazene Binders", the disclosure of which is totally incorporated herein by reference.

In one specific embodiment, the present invention is directed to a layered photoconductive imaging member comprised of a supporting substrate, in contact therewith a ground plane layer comprised of, for example, conductive polymers such as polyacetylenes, polypyrroles; organic compounds such as carbon black; metals such as copper, gold, and the like; metal salts including copper iodide, tin oxide, indinium oxide, and the like; a hole blocking-adhesive polyorganophosphazene layer in contact with the ground plane layer; a photogenerating layer comprised of organic or inorganic photoconductive pigments optionally dispersed in an inactive resinous binder; and in contact therewith a charge, and preferably a hole transport layer comprised of, for example, the aryl amines as illustrated in U.S. Pat. No. 4,265,990, the disclosure of which is totally incorporated herein by reference, which amines can be optionally dispersed in an inactive resin binder.

Various known phosphazenes, including polyorganophosphazenes, can be selected as the hole blocking-adhesive layer including those illustrated in U.S. Pat. No. 4,657,993, the disclosure of which is totally incorporated herein by reference, and those described in *Chemical And Engineering News*, Mar. 18, 1985, pages 22 to 35, the disclosure of which is totally incorporated herein by reference. Also, some of the polyorganophosphazenes are available from Nisso Kako Limited of Japan, reference for example the polyphosphazenes of working Examples I and II.

Specific examples of polyorganophosphazenes include those of the following Formulas

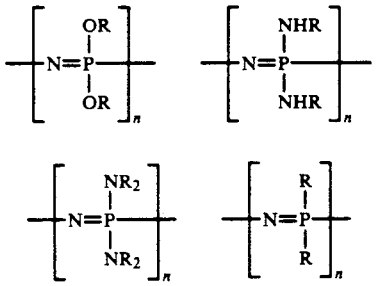

wherein R is a substituent such as aryl, alkyl, substituted aryl, substituted alkyl, and the like; and n represents the number of repeating segments, for example, n can be a number of from 1 to about 100. Aryl includes those substituents with from about 6 to about 24 carbon atoms such as phenyl, phenyltolyl, xylyl, naphthyl, and the like. Alkyl includes, for example, those substituents with from 1 to about 25 carbon atoms such as methyl, ethyl, propyl, butyl, octyl, and the like.

Preferred polyorganophosphazenes include bis p-tolylamino polyphosphazene, poly[bis(dialkylamino)]-phosphazene and poly[bis(diarylamino)]phosphazenes, such as poly[bis(dimethylamino)]phosphazene, poly[-bis(diethylamino)]phosphazene, poly[bis(dipropylamino)]phosphazene, poly[bis(dibutylamino)]-phosphazene, poly[bis(p-ditolylamino)]phosphazene, poly[bis(carbazolyl)]phosphazene, poly[bis(dialkyl)]-phosphazene, poly[bis(diaryl)]phosphazene, such as poly(dimethyl)phosphazene, poly(diethyl)phosphazene, poly(dibenzyl)phosphazene, poly(ditolyl)phosphazene, poly(dixylyl)phosphazene, poly[bis(alkoxy)]-phosphazene, poly[bis(aryloxy)]phosphazene, such as poly[bis(methoxy)]phosphazene, poly[bis(ethoxy)]-phosphazene, poly[bis(propyloxy)]phospazene, poly[-bis(trifluoroethoxy)]phosphazene, poly[bis(2-naphthoxy)]phosphazene, poly[bis(2-tolyloxy)]phosphazene, poly[bis(phenoxy)]phosphazene, poly[bis(p-bromophenoxy)]phosphazene, poly[bis(p-chlorophenoxy)]-phosphazene, poly[bis(arylamino)]phosphazene, poly[-bis(alkylamino)]phosphazene, poly[bis(methylamino)]-phosphazene, poly[bis(ethylamino)]phosphazene, poly[-bis(p-tolylamino)]phosphazene, poly[bis(p-anilino)]-phosphazene, poly[bis(2-naphthylamino)]phosphazene, poly[bis(p-xylylamino)]phosphazene, and the like. Generally this layer can be of any effective thickness including, for example, from about 0.005 to about 2, and preferably from about 0.01 to about 1, and more preferably from about 0.05 to about 0.5 microns. It is preferred that the materials be electronically pure, that is for example that the residual chlorine be removed therefrom, which purification can be accomplished by a number of known methods including those illustrated in copending application U.S. Ser. No. 07/386,322, entitled "Photoconductive Imaging Members With Polyphosphazene Binders", the disclosure of which has been totally incorporated herein by reference.

Examples of specific charge hole transporting components that may be selected for the imaging member of the present invention include the aryl amines of the following formula, wherein X is independently halogen or alkyl, and preferably N,N'-diphenyl-N,N'-bis(3-methyl phenyl)-(1,1'-biphenyl)-4,4'-diamine, and those of Formulas II to XI wherein n represents the number of repeating units such as, for example, from about 10 to about 300.

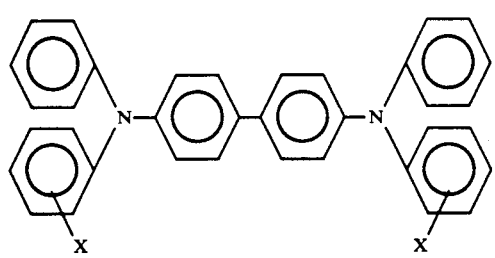

I

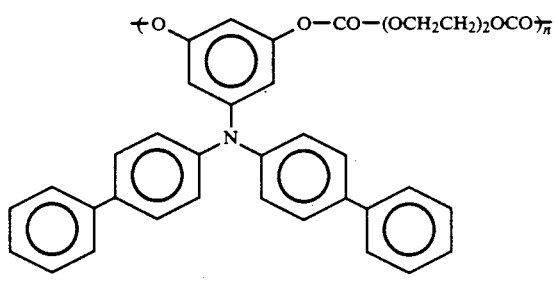

II

-continued
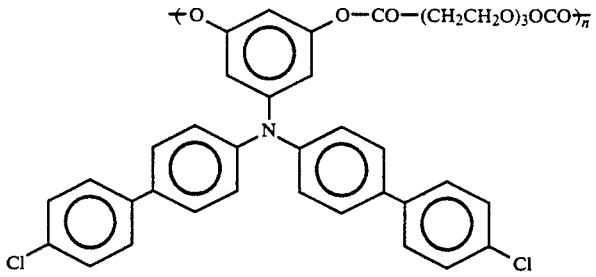
III
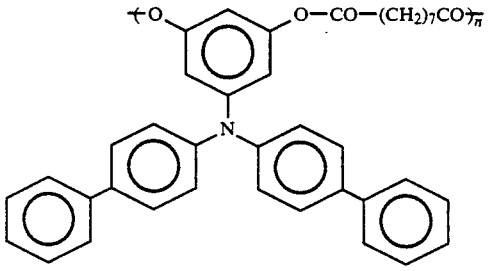
IV
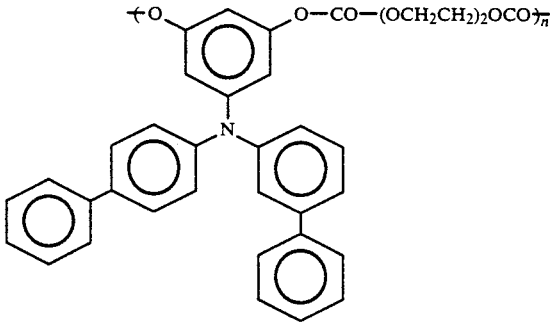
V
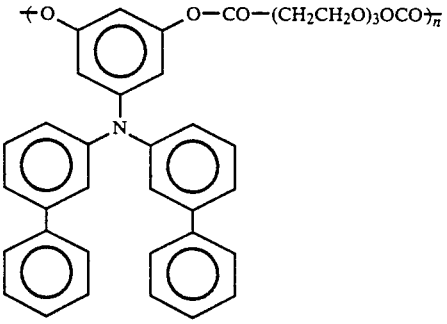
VI
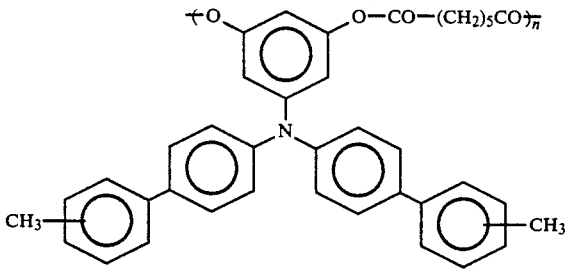
VII

-continued

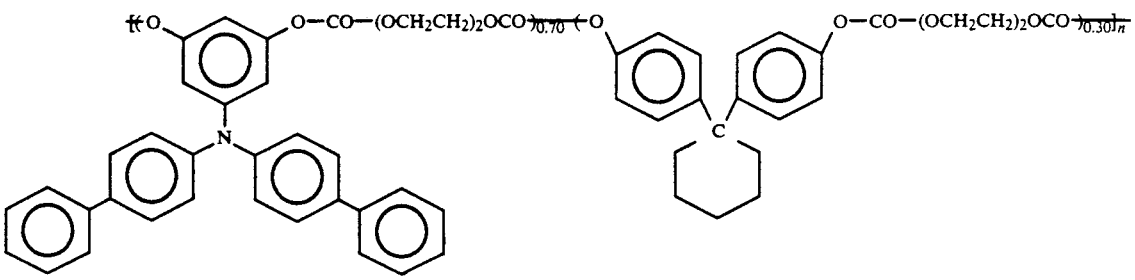

VIII

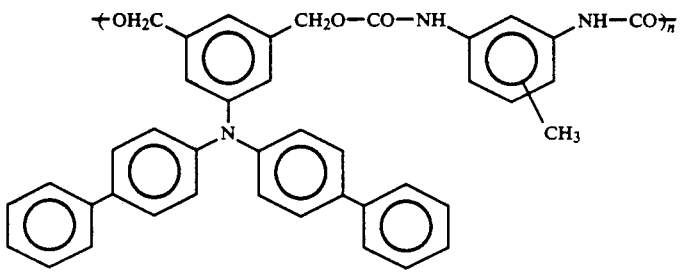

IX

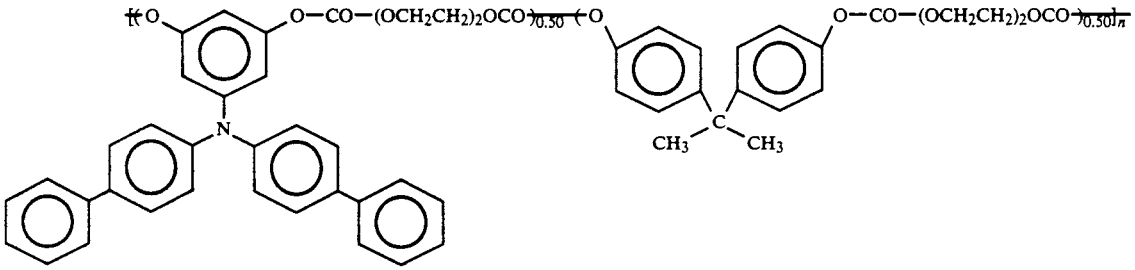

X

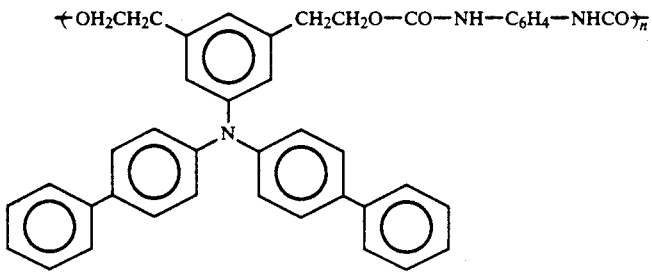

XI

The preferred charge transporting molecules are the aryl amines illustrated herein of Formula I. This layer can be of any effective thickness; generally, however, in one embodiment of the present invention the thickness of the hole or charge transport layer is from about 10 to about 60, and preferably about 25 microns.

Examples of supporting substrates, ground planes, photogenerating components, resin binders and the like are as illustrated herein, including those disclosed in the U.S. patents mentioned herein, and the copending applications thereof.

The photoresponsive imaging members of the present invention can be prepared by a number of known methods, the process parameters and the order of the coating of the layers being dependent on the member desired. Thus, for example, the photoresponsive members of the present invention can be prepared by providing a conductive substrate with a ground plane, the charge blocking-adhesive layer, and applying thereto a photogenerating layer, and overcoating thereon a charge transport layer. The photoresponsive imaging members of the present invention can be fabricated by common known coating techniques such as by dip coating, draw-bar coating, or by spray coating process, depending mainly on the type of imaging devices desired. Each coating, however, can be usually dried, for example, in a convection or forced air oven at a suitable temperature before a subsequent layer is applied thereto.

DETAILED DESCRIPTION OF THE INVENTION

Figure 1:
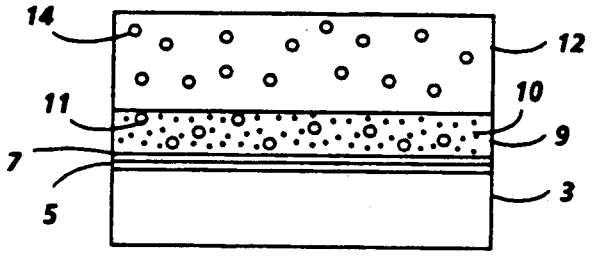
FIG. 1 represents a partially schematic cross-sectional view of a photoresponsive imaging member of the present invention.

Illustrated in FIG. 1 is a photoresponsive imaging member of the present invention comprising a supporting substrate 3 of a thickness of about 75 microns to about 5,000 microns, a ground plane layer 5, of a thickness of from about 100 Angstroms to about 500 Angstroms, a hole blocking-adhesive polyorganophosphazene layer 7 of a thickness of from about 0.005 to about 2 microns, a charge carrier photogenerating layer 9 of a thickness of from about 0.5 micron to about 5 microns comprised of a photogenerating pigment 10 optionally dispersed in inactive resinous binder composition 11, and a hole transport layer 12 of a thickness of from about 10 microns to about 60 microns comprised of an aryl amine dispersed in a resin binder 14.

Figure 2:
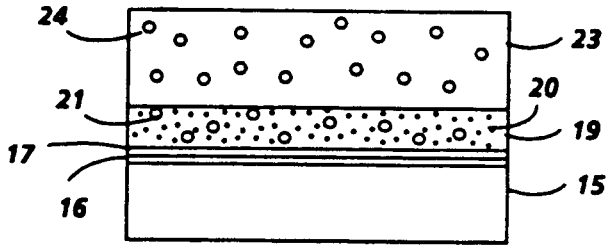
FIGS. 2 and 3 represent partially schematic cross-sectional views of preferred photoresponsive imaging members of the present invention.

Illustrated in FIG. 2 is a photoresponsive imaging member of the present invention comprised of a 25 micron to about 100 micron thick conductive supporting substrate 15 of aluminized Mylar, a ground plane layer 16, of titanium in a thickness of from about 0.5 to about 1 micron, a hole blocking-adhesive polyorganophosphazene layer 17 of a thickness of from about 0.5 micron to about 2 microns, a 0.5 to about 5 micron thick photogenerating layer 19 comprised of trigonal selenium photogenerating pigments 20 optionally dispersed in a resinous binder 21 in the amount of 10 percent to about 80 percent by weight, and a 10 micron to about 60 micron thick hole transport layer 23 comprised of an aryl amine charge transport dispersed in a Makrolon polycarbonate resin binder 24.

Figure 3:
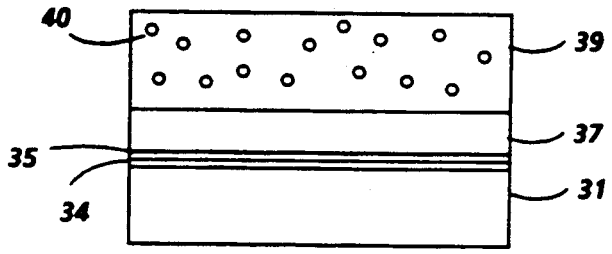

Another photoresponsive imaging member of the present invention, reference FIG. 3, is comprised of a conductive supporting substrate 31 of aluminum of a thickness of 50 microns to about 5,000 microns, a ground plane layer 34 of copper iodide, or a conductive polymer such as polypyrrole, or mixtures thereof in a thickness of from about 0.1 to about 1 micron, a hole blocking-adhesive polyorganophosphazene layer 35, such as poly[bis(p-tolylamino)]phosphazene of a thickness of from about 0.5 micron to about 1 microns, a photogenerating layer 37 comprised of amorphous selenium or an amorphous selenium alloy, especially selenium arsenic (99.5/0.5) and selenium tellurium (90/10), of a thickness of 0.1 micron to about 5 microns, and a 10 micron to about 60 micron thick hole transport layer 39 comprised of the aryl amine hole transport of Formula I, and more specifically N',N'-diphenyl-N,N'-bis(3-methyl phenyl)-(1,1'-biphenyl)-4,4'-diamine, 55 weight percent, dispersed in a Makrolon polycarbonate resin binder 40, 45 weight percent.

Figure 4:
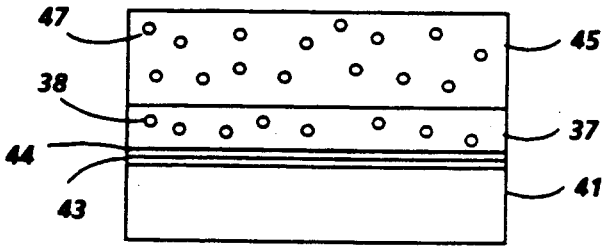
FIG. 4 represents a partially schematic cross-sectional view of a photoresponsive imaging member of the present invention wherein the charge or hole transporting layer is situated between a supporting substrate, and the photogenerating layer.

Illustrated in FIG. 4 is another photoresponsive imaging member of the present invention comprised of a 25 microns to 100 microns thick conductive supporting substrate 41 of aluminized Mylar, a ground plane layer 43 of copper iodide, or a conductive polymer such as polypyrrole components, in a thickness of from about 0.1 to about 1 micron, a hole blocking-adhesive polyorganophosphazene layer 44, such as poly[bis(p-tolylamino)]phosphazene of a thickness of from about 0.5 micron to about 1 micron, the photogenerating layer 37 of FIG. 3 optionally dispersed in a resin binder 38, a 10 microns to about 60 microns thick hole transport layer 45 comprised of aryl amine charge transport molecules dispersed in (1) a resin binder 47 of poly[bis(p-tolylamino)]phosphazene, prepared by the nucleophilic displacement of halogen atoms of poly(pdichloro)phosphazene with p-toluidine; and wherein the poly(dichloro)phosphazene was prepared from commercially available hexachlorocyclotriphosphazene, (2) or a Makrolon polycarbonate; or wherein the hole blocking adhesive layer 44 is poly[bis(2-naphthoxy)]phosphazene which was prepared, for example, by the process of Example IV.

The supporting substrate layers may be opaque or substantially transparent and may comprise any suitable material having the requisite mechanical properties. The substrate may comprise a layer of an organic or inorganic material having a conductive surface layer arranged thereon or a conductive material such as, for example, aluminum, chromium, nickel, indium, tin oxide, brass or the like. The substrate may be flexible or rigid and can have any of many different configurations such as, for example, a plate, a cylindrical drum, a scroll and the like. The thickness of the substrate layer is dependent on many factors including, for example, the components of the other layers, and the like; generally, however, the substrate is of a thickness of from about 50 microns to about 5,000 microns.

Typical ground planes, preferably of a thickness of from about 100 Angstroms to about 2,000 Angstroms, include conductive polymers such as polypyrrole components; organics such as carbon black; copper iodide; titanium oxide; zirconium/titanium oxides; and the like.

Illustrative examples of the hole blocking adhesive layers of a thickness of from about 0.5 to about 1 micron include the polyphosphazenes, especially the polyorganophosphazenes illustrated herein, and preferably poly[bis(p-tolylamin]phosphazene and poly[bis(2-naphthoxy)]phosphazene which are available from Nisso Kako Ltd. of Japan. The primary advantage of the organopolyphosphazenes is its combined hole blocking and adhesive characteristics. Thus, the layer of adhesive material located, for example, between the transport layer and the photogenerating layer to promote adhesion thereof selected for the prior art layered imaging members can be avoided. This layer when selected for prior art members is comprised of known adhesive materials such as polyester resins, reference 49,000 polyester available from Goodyear Chemical Company, polysiloxane, acrylic polymers, and the like. A thickness of from about 0.001 micron to about 0.1 micron for this layer is generally employed for the adhesive layer. Also, in the prior art imaging members there can be selected as hole blocking layers usually situated between the substrate and the photogenerating layer those derived from the polycondensation of aminopropyl trialkoxysilane or aminobutyl trialkoxysilane, such as 3-aminopropyltrimethoxysilane, 3-aminopropyltriethoxysilane, or 4-aminobutyltrimethoxysilane may optionally be introduced to improve the dark decay characteristics of the imaging member. Typically, this layer has a thickness of from about 0.001 micron to about 5 microns or more in thickness, depending on the effectiveness with which this layer prevents the dark injection of charge carriers into the photogenerating layer.

Examples of preferred photogenerating layers, especially since they permit imaging members with a photoresponse of from about 400 to about 700 nanometers, for example, include those comprised of known photoconductive charge carrier generating materials, such as amorphous selenium alloys, halogen doped amorphous selenium, halogen doped amorphous selenium alloys, trigonal selenium, mixtures of Groups IA and IIA, elements selenite and carbonates with trigonal selenium, reference U.S. Pat. Nos. 4,232,102 and 4,233,283, the disclosures of each of these patents being totally incorporated herein by reference, copper, and chlorine doped cadmium sulfide, cadmium selenide and cadmium sulfur selenide, and the like. Examples of specific alloys include selenium arsenic with from about 95 to about 99.8 weight percent selenium; selenium tellurium with from about 50 to about 98 weight percent of selenium; the aforementioned alloys containing halogens such as chlorine in amounts of from about 100 to about 1,000 parts per million; ternary alloys; and the like. The thickness of the photogenerating layer is dependent on a number of factors, such as the materials included in the other layers, and the like; generally, however, this layer is of a thickness of from about 0.1 micron to about 5 microns, and preferably from about 0.2 micron to about 2 microns, depending on the photoconductive volume loading, which may vary from about 5 percent to about 100 percent by weight. Generally, it is desirable to provide this layer in a thickness which is sufficient to absorb about 90 percent or more of the incident radiation which is directed upon it in the imagewise exposure step. The maximum thickness of this layer is dependent primarily upon factors such as mechanical considerations, and for example, whether a flexible photoresponsive device is desired. Also, there may be selected as photogenerators organic components such as squaraines, perylenes, reference for example U.S. Pat. No. 4,587,189, the disclosure of which is totally incorporated herein by reference, metal phthalocyanines, metal free phthalocyanines, vanadyl phthalocyanine, dibromoanthanthrone, and the like.

Examples of resin binders for the photogenerator present in effective amounts of, for example, from 5 to about 25 weight percent include polyvinylcarbazole, polyvinylbutyral, polyhydroxyether, and the like. Typical binders for the transport layer are as illustrated herein, including those as disclosed in the patents in copending applications mentioned herein, such as polycarbonates, including PC (Z) available from Mitsubishi Gas Chemical Company of New York, and the like. From about 40 to about 60 weight percent of resin binder can be selected for the charge transport molecules, however, other effective percentages can be utilized including those below 40 percent and those above 60 percent.

Seamless imaging members of the present invention are comprised of the same components of the seam members, reference for example the member of FIG. I.

Imaging methods that can be selected with the members of the present invention include electrophotographic, and preferably xerographic. Also, the members of the present invention can be selected for electrophotographic printing process. Development of the images can be accomplished with developer compositions comprised of toner and carrier particles, reference U.S. Pat. Nos. 4,298,672; 3,590,000; 3,983,045 and 4,560,635, the disclosures of which are totally incorporated herein by reference.

In one embodiment, with the imaging member of the present invention as illustrated, for example, in FIG. I wherein poly[bis(2-naphthoxy]polyphosphazene is selected as the hole blocking and adhesive layer there resulted excellent electrical characteristics, such as a dark decay of −157 volts, cycle down after 50 imaging cycles in an imaging test fixture of −70 volts, a residual charge of −3 volts, and the like, which electrical characteristics were determined at about 5 percent relative humidity with a xerographic testing scanner. Also, the photosensitivity of the imaging members of the present invention was excellent, for example the specific aforementioned imaging member had an $E_{\frac{1}{2}}$ in ergs/cm$^2$ of 1.8. These measurements were accomplishd in a standard xerographic scanner.

The following examples are being supplied to further define specific embodiments of the present invention, it being noted that these examples are intended to illustrate and not limit the scope of the present invention. Also, parts and percentages are by weight unless otherwise indicated.

EXAMPLE I

Separate Blocking and Adhesive Layers

A photoresponsive imaging member was prepared by providing a titanium coated polyester, available from ICI Inc., substrate in a thickness of 3 mils, followed by applying thereto with a multiple-clearance film Bird applicator a solution of 2.59 grams of 3-aminopropyltrimethoxysilane (available from PCR Research Chemicals), 0.78 gram of acetic acid, 180 grams of ethyl alcohol, and 77.3 grams of heptane. This blocking layer, 0.5 micron, was dried for 5 minutes at room temperature, and then cured for 10 minutes at 110° C. in a forced air oven.

There was then applied to the silane blocking layer a coating with a wet thickness of 0.5 mil and containing 5 weight percent based on the weight of the entire solution of a solution of 49,000 polyester, available from E.I. DuPont Chemical in a 70:30 mixture of tetrahydrofuran/cyclohexanone with a multiple-clearance film Bird applicator. The layer was allowed to dry for one minute at room temperature, and 5 minutes at 135° C. in a forced air oven. The resulting adhesive layer had a dry thickness of 0.05 micron.

The above adhesive layer was then coated with a photogenerating layer containing 7.5 percent by volume of trigonal selenium, 25 percent by volume of N,N'-bis(3-methylphenyl)-1,1'-biphenyl-4,4-diamine, and 67.5 percent by volume of polyvinylcarbazole. This photogenerating layer was prepared by introducing 0.8 gram of polyvinylcarbazole and 14 milliliters of a 1:1 volume mixture of tetrahydrofuran and toluene in a 2 ounce amber bottle. To this solution was added 0.8 gram of trigonal selenium and 100 grams of ⅛ inch diameter stainless steel shot. The resulting mixture was then placed on a ball mill for 96 hours. Subsequently, 5 grams of the resulting slurry were added to a solution of 0.36 gram of polyvinylcarbarzole and 0.20 gram of N,N'-diphenyl-N,N'-bis(3-methylphenyl)-1,1'-biphenyl-4,4-diamine, in 7.5 milliliters of a 1:1 volume ratio of tetrahydronfuran/toluene. The slurry resulting was then placed on a paint shaker for 10 minutes. The resulting slurry was then applied to the above adhesive layer with a Bird applicator to form a layer with a wet thickness of 0.5 mil. This layer was then dried at 135° C. for 5 minutes in a forced air oven to form the photogenerating layer with a thickness of 2.0 microns.

The above photogenerating layer was then overcoated with a hole transport layer, which layer was prepared by introducing into an amber glass bottle in a weight ratio of 1:1 N,N'-diphenyl-N,N'-bis(3-methylphenyl)-1,1'-biphenyl-4,4and the polyester nakrolon 5705, a polycarbonate having a weight average molecular weight of from about 50,000 to about 100,000, and available from Larbensabricken Bayer AG. The resulting mixture was dissolved in methylene chloride to provide a 15 weight percent solution thereof. This solution was then applied to the above prepared photogenerator layer with a Bird applicator to form a coating thereon with a dry thickness of 25 microns. During this coating process the relative humidity was about 14 percent. The resulting photoconductive member was then annealed at 135° C. in a forced air oven for 5 minutes.

An anticurl coating layer was then prepared by combining 8.82 grams of the above Makrolon polycarbonate, 8.18 percent solids, 0.09 gram of Vitel PE 100 polyester resin available from Goodyear Chemical, and 90.07 grams of methylene chloride in a glass bottle to form a coating solution containing 8.9 percent solids. The glass bottle was tightly covered and placed on a roll mill for about 24 hours until the polycarbonate and the polyester were dissolved in the methylene chloride. The resulting anticurl coating solution was applied to the back surface of the Mylar substrate with a Bird applicator and the resulting member was then dried for 5 minutes at 135° C. in a forced air oven resulting in a thin anticurl layer of a thickness of 13.5 microns.

The fabricated imaging member was electrically tested by negatively charging it with a corona, and discharged by exposing to white light of wavelengths of from 400 to 700 nanometers under 5 percent relative humidity and at 21° C. Charging was accomplished with a single pin corotron, and the charging time was 33 milliseconds. The acceptance potential of this imaging member after charging, and its residual potential after exposure were recorded. The procedure was repeated for different exposure energies supplied by a 250 watt xenon arc lamp of incident radiation, and the exposure energy required to discharge the surface potential of the member to half of its original value was determined. This surface potential was measured with a standard xerographic scanner.

The above imaging member was negatively charged to a surface potential of 900 volts, and discharged to a residual potential of 34 volts. The dark decay of this device was about −153 volts/second. Further, the electrical properties of the above prepared photoresponsive imaging member retained very little charge (−65 volts cycle down) unchanged for 50,000 cycles of repeated charging and discharging. The residual charge of this member was −6 volts, and the $E_{\frac{1}{2}}$ was 1.7 erg/cm$^2$.

EXAMPLE II

A layered photoresponsive imaging member was fabricated by repeating the procedure of Example I with the exception that the blocking trimethoxysilane layer was omitted. This imaging member had a dark decay of −311 volts/second, a cycle down after 50,000 imaging cycles of −33 volts, a residual potential charge of 11 volts and an $E_{\frac{1}{2}}$ of 1.7 ergs/cm$^2$. With the imaging member of Example I, the dark decay was −311 volts/-second, the cycle down after 50,000 imaging cycles was −65 volts, the residual charge after 50,000 imaging cycles was 6 volts, and the $E_{\frac{1}{2}}$ was 1.7 ergs/cm$^2$.

EXAMPLE III

A layered photoresponsive imaging member was prepared by repeating the procedure of Example I with the exceptions that the trimethoxysilane blocking layer, and the 49,000 polyester layer were replaced with one blocking-adhesive layer comprised of poly[bis(p-tolylamino)]phosphazene obtained from Nisso Kako Ltd. of Japan. This blockin/adhesive layer was coated with a 0.5 weight percent of the above polyphosphazene (in tetrahydrofuran, 0.5 percent polyphosphazene, 99.5 percent THF) solution with a Bird applicator and the wet film thereafter dried at 135° C. in a forced air oven for 5 minutes to yield a dried film thickness of 0.05 micron. The resulting imaging member had a dark decay of −154 volts/second, a cycle down after 50,000 imaging cycles of −61 volts, a residual potential of 9 volts and an $E_{\frac{1}{2}}$ of 1.8 ergs/cm$^2$. These electrical results indicate that the above polyphosphazene was an excellent hole blocking layer equivalent to the capability of a silane in preventing hole injection. No photoreceptor delamination (separation of layers) was observed which indicates that the bis phosphazene has adhesive characteristic similar to the 49,000 polyester adhesive.

EXAMPLE IV

A layered photoresponsive imaging member was prepared by repeating the procedure of Example III with the exception that poly[bis(2-naphthoxy)]phosphazene was selected as the hole blocking-adhesive layer in place of the poly[bis(p-trolylamino)]phosphazene. This imaging member had a dark decay of −157 volts/-second, a cycle down after 50,000 imaging cycles of −70 volts, a residual potential charge of −3 volts and an $E_{\frac{1}{2}}$ of 1.8 ergs/cm$^2$.

As indicated herein, the polyorganophosphazenes can be purified by forming a 10 percent solution thereof in toluene or tetrahydrofuran. The solution can then be added dropwise five times its volume to boiling methanol, and thereafter a white precipitate normally forms, on termination of the addition, which precipitate was then filtered. The above procedure can be repeated, for example, three times and the final reprecipitation can be accomplished from boiling hexane. Typically, for example, 10 grams of the polyphosphazene were dissolved in 100 milliliters of toluene, and over a period of 30 minutes this solution was added to 500 milliliters of stirring hot (boiling) hexane. The white precipitate formed was a polyphosphazene and this was collected by filtration, dried and selected as the hole blocking adhesion layer for the imaging members of Examples III and IV. Electronic impurities removed by the aforementioned methods and other known methods include, for example, chlorine. Subsequently, the purity of the polyphosphazene can be determined by Infrared Spectroscopy and Differential Pulse Polarography. Moreover, the structure of the polyphosphazene can be confirmed by elemental analysis, ultraviolet light spectroscopy, nuclear magnetic resonance, and mass spectroscopy.

Although the invention has been described with reference to specific preferred embodiments, it is not intended to be limited thereto, rather those skilled in the art will recognize variations and modifications may be made therein which are within the spirit of the invention and within the scope of the following claims.

What is claimed is:

1. A photoconductive imaging member comprised of a supporting substrate, a ground plane layer, a hole blocking-adhesive layer comprised of polyorganophosphazene, a photogenerating layer, and a hole transport layer.

2. A photoconductive imaging member in accordance with claim 1 wherein the polyorganophosphazenes, are of the following formulas

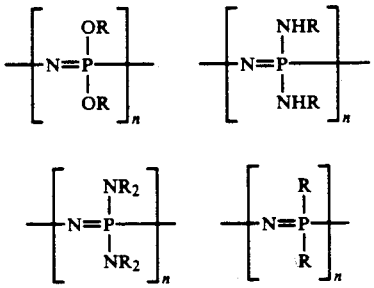

wherein R is independently selected from alkyl, aryl, substituted alkyl, and substituted aryl; and n represents the number of repeating segments.

3. A photoconductive imaging member in accordance with claim 1 wherein the polyorganophosphazenes are selected from the group consisting of poly[bis(p-tolylamino)]phosphazene, poly[bis(2-naphthoxy)]phosphazene, poly[bis(dialkylamino)]phosphazene, poly[bis(diarylamino)]phosphazenes, poly[bis(dimethylamino)]phosphazene, poly[bis(diethylamino)]phosphazene, poly[bis(dipropylamino)]phosphazene, poly[bis(dibutylamino)]phosphazene, poly[bis(p-ditolylamino)]phosphazene, poly[bis(carbazolyl)]phosphazene, poly[bis(dialkyl)]phosphazene, poly[bis(diaryl)]phosphazene, poly(dimethyl)phosphazene, poly(diethyl)phosphazene, poly(dibenzyl)phosphazene, poly(ditolyl)phosphazene, poly(dixylyl)phosphazene, poly[bis(alkoxy)]phosphazene, poly[bis(aryloxy)]phosphazene, poly[bis(methoxy)]phosphazene, poly[bis(ethoxy)]phosphazene, poly[bis(propyloxy)]phosphazene, poly[bis(trifluoroethoxy)]phosphazene, poly[bis(2-naphthoxy)]phosphazene, poly[bis(2-tolyloxy)]phosphazene, poly[bis(phenoxy)]phosphazene, poly[bis(p-bromophenoxy)]phosphazene, poly[bis(p-chlorophenoxy)]phosphazene, poly[bis(arylamino)]phosphazene, poly[bis(alkylamino]phosphazene, poly[bis(methylamino)]phosphazene, poly[bis(ethylamino)]phosphazene, poly[bis(p-tolylamino)]phosphazene, poly[bis(p-anilino)]phosphazene, poly[bis(2-naphthylamino)]phosphazene, and poly[bis(p-xylylamino)]phosphazene.

4. A photoconductive imaging member in accordance with claim 1 wherein the ground plane is a conductive polymer, an organic component, a metal, or a metal salt.

5. A photoconductive imaging member in accordance with claim 4 wherein the ground plane is titanium, aluminum, indium/tin oxide, zirconium/titanium, nickel, or mixtures thereof.

6. A photoconductive imaging member in accordance with claim 4 wherein the conductive ground plane is carbon black, or a conductive polymer.

7. A photoconductive imaging member in accordance with claim 6 wherein the conductive polymer ground plane is polypyrrole.

8. A photoconductive imaging member in accordance with claim 1 wherein the supporting substrate is comprised of an insulating polymer containing on its surface a conductive polymer or a metal oxide, a conductive polymer, or a metal oxide.

9. A photoconductive imaging member in accordance with claim 1 wherein the hole transport layer is an aryl amine.

10. A photoconductive imaging member in accordance with claim 1 wherein the hole transport layer is the aryl amine of the formula

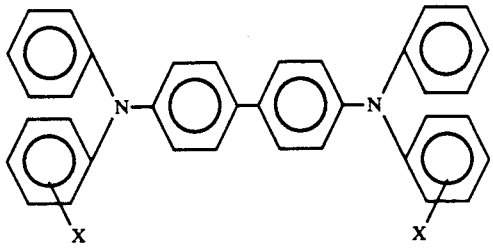

wherein X is independently selected from the group consisting of alkyl and halogen.

11. A photoconductive imaging member in accordance with claim 2 wherein the hole transport layer is the aryl amine N,N'-diphenyl-N,N'-bis(3-methylphenyl)-(1,1'-biphenyl)-4,4'-diamine.

12. A photoconductive imaging member in accordance with claim 1 wherein the hole transport layer is comprised of the N,N-bis(biarylyl)aniline polymers of the formula

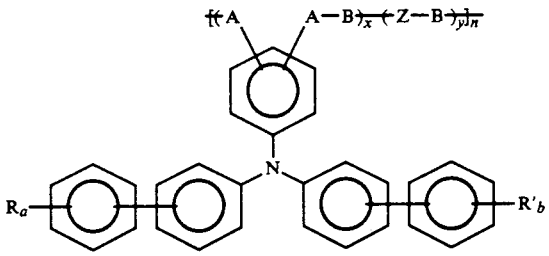

wherein A and B are independently selected from bifunctional linkages; Z is alkylenedioxy, arylenedioxy, or substituted derivatives thereof; R and R' are alkyl, aryl, alkoxy, aryloxy, or halogen; x and y are mole fractions wherein x is greater than 0 and the sum of x is equal to 1.0; a and b are the numbers 0, 1 or 2; and n represents the number of monomer units.

13. A photoconductive imaging member in accordance with claim 1 wherein the hole transport molecules are dispersed in an inactive resin binder.

14. A photoconductive imaging member in accordance with claim 1 wherein the photogenerating layer is comprised of inorganic or organic photoconductive pigments.

15. A photoconductive imaging member in accordance with claim 14 wherein the photogenerating layer is comprised of selenium, selenium alloys, trigonal selenium, vanadyl phthalocyanine, squaraines, perylene, metal free phthalocyanines, metal phthalocyanines, or dibromoanthanthrone photoconductive pigments.

16. A photoconductive imaging member in accordance with claim 15 wherein the photogenerating pigments are dispersed in a resin binder.

17. A photoconductive imaging member in accordance with claim 1 wherein the photogenerating layer is situated between the supporting substrate and the hole transport layer.

18. A photoconductive imaging member in accordance with claim 1 wherein the hole transport layer is situated between the photogenerating layer and the supporting substrate.

19. A photoconductive imaging member in accordance with claim 18 wherein the supporting substrate is comprised of an insulating polymer with a conductive polymer, a metal oxide, or mixtures thereof on the surface.

20. A photoconductive imaging member in accordance with claim 1 wherein the photogenerating pigments are dispersed in a resinous binder in an amount of from about 5 percent by weight to about 95 percent by weight.

21. A photoconductive imaging member in accordance with claim 20 wherein the resinous binder is a polyester, polyvinyl butyral, a polycarbonate, or polyvinyl formal.

22. A seamless photoconductive imaging member comprised of a supporting substrate, a ground plane layer, a hole blocking-adhesive layer comprised of polyorganophosphazenes, a photogenerating layer, and a hole transport layer.

23. A method of imaging which comprises generating an electrostatic image on the imaging member of claim 1; developing the image; subsequently transferring this image to a suitable substrate; and thereafter permanently affixing the image thereto.

24. A method of imaging which comprises generating an electrostatic image on the imaging member of claim 2; developing the image; subsequently transferring this image to a suitable substrate; and thereafter permanently affixing the image thereto.

25. A method of imaging which comprises generating an electrostatic image on the imaging member of claim 22; developing the image; subsequently transferring this image to a suitable substrate; and thereafter permanently affixing the image thereto.

26. A photoconductive imaging member in accordance with claim 1 wherein a polyphosphazene is selected as a resin binder for the hole transport layer.

27. An imaging member in accordance with claim 2 wherein n is a number of from 1 to about 100.

28. A photoconductive imaging member comprised of a ground plane layer, a hole blocking-adhesive layer comprised of a polyorganophosphazene, a photogenerating layer, and a hole transport layer.

29. A photoconductive imaging member comprised of a supporting substrate, in contact therewith a ground plane layer; a hole blocking-adhesive layer in contact with a ground plane layer, and comprised of polyorganophosphazenes; a photogenerating layer in contact with the hole blocking-adhesive layer; and a hole transport layer in contact with the photogenerating layer.

30. A layered photoconductive imaging member comprised in the order stated of a supporting substrate, a ground plane layer, a hole blocking adhesive layer comprised of a polyorganophosphazene, a photogenerating layer and a hole transport layer.

31. An imaging member in accordance with claim 30 wherein the polyphosphazene is of the following formula:

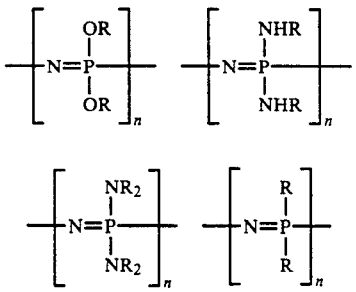

wherein R is independently selected from alkyl, aryl, substituted alkyl, and substituted aryl; and represents the number of repeating segments.

32. An imaging member in accordance with claim 30 wherein the photogenerating layer is comprised of inorganic or organic photoconductive pigments.

33. An imaging member in accordance with claim 30 wherein the polyphosphazene functions as a hole blocking-adhesive component.

* * * * *